United States Patent [19]

Kaempfer

[11] 4,230,055

[45] Oct. 28, 1980

[54] MATERIAL HOLD-DOWN

[75] Inventor: Gerhard P. Kaempfer, Wyoming, Mich.

[73] Assignee: Wolverine World Wide, Inc., Rockford, Mich.

[21] Appl. No.: 31,190

[22] Filed: Apr. 18, 1979

[51] Int. Cl.[2] ..... D05B 29/04

[52] U.S. Cl. ..... 112/236; 112/227

[58] Field of Search ..... 112/60, 240, 235, 261, 112/236, 121.12, 227, 257, 250

[56] References Cited

U.S. PATENT DOCUMENTS

| | | | |
|---|---|---|---|
| 983,343 | 2/1911 | Bayer | 112/227 |
| 1,187,074 | 6/1916 | Loeb | 112/236 |
| 1,408,821 | 3/1922 | Merrick | 112/227 |
| 1,623,075 | 4/1927 | Thomas | 112/121.12 |
| 1,959,138 | 5/1934 | Nimmer | 112/235 |
| 4,008,672 | 2/1977 | Gianciotti | 112/121.12 |
| 4,114,545 | 9/1978 | Manabe et al. | 112/121.12 X |

*Primary Examiner*—Werner H. Schroeder
*Assistant Examiner*—Andrew M. Falik
*Attorney, Agent, or Firm*—Price, Heneveld, Huizenga & Cooper

[57] ABSTRACT

A material hold-down device, cooperative with the stitching needle bar of a stitching machine, and employing a template that retains layers of material to be stitched. The hold-down has a vertical tubular cylindrical sleeve in sliding bearing relationship with the reciprocal cylindrical needle bar, a laterally projecting mounting portion extending therefrom, and an elongated lower hollow nose coaxial with the sleeve, of smaller diameter than the sleeve, and joined thereto by a frustoconical juncture. The sleeve has an open side of less than 180° extent, leaving the remaining wall portion greater than 180°, and has a smaller opening opposite the open side, for access to the needle and needle bar.

3 Claims, 8 Drawing Figures

MATERIAL HOLD-DOWN

BACKGROUND OF THE INVENTION

This invention relates to material hold-down mechanism for a stitching machine, particularly as employed with book-type templates as on an automatic digitized stitching machine for making footwear and the like.

This invention was initially developed for the manufacture of footwear such as shoes and boots, and for convenience will therefore be explained largely in that environment. However, it will be understood that the invention is applicable to other environments involving stitching together of layers.

In shoe manufacture, the stitching together of several overlapping layers is commonly accomplished with the aid of a multiple sheet template with the sheets in hinged relationship similar to a "book", the individual layers of material to be stitched, e.g. leather, cloth, etc., being selectively retained between the template sheets. Elongated configurated openings in the template sheets are aligned with each other to allow the stitching needle to penetrate the entire template for stitching the layers together.

In recent years, automatic digitized stitching machines have been available wherein the template book, with the layers of material therein, are clamped to a feed control on the bed of the stitching machine. The feed control incrementally shifts the templates in two horizontal dimensions on a programmed basis to achieve the predetermined stitching pattern during vertical reciprocation of the needle and needle bar. In such an arrangement, it is apparent that the thickness, i.e. height, of the template book on the bed of a machine will depend on the number of layers to be stitched as well as the individual thickness of the layers. Moreover, since the layers are typically of differing dimensions and shapes, the template and material thickness or height will vary from portion to portion thereof.

During the stitching operation, the top layer of material is engaged by the material hold-down device which projects into the opening of the uppermost leaf of the template. This device typically has a small cylindrical nose portion surrounding the reciprocating stitching needle, with its end surface engaging the material prior to the needle penetrating the material. A conventional hold-down for this purpose is depicted in the drawings, specifically at FIGS. 7 and 8. Such units comprise costly specially made castings.

This conventional hold-down has presented problems, particularly when used in the automatic digitized stitching machines. Specifically, the shoulder projecting laterally above the nose repeatedly strikes the edges of the openings of the top template sheet, causing damage and sometimes breakage of the hold-down unit, causing damage to the template, and causing excessive wear on the machinery because of the lateral stresses applied. In efforts to minimize this, the template openings through which the needle projects have been enlarged to effect more lateral space between the needle and the edges of the template. While this does lessen the instances of the hold-down striking the template, it also lessens the clamping effectiveness on the material near the needle, and even allows some narrow material edges to remain unclamped. This too often results in reject products. Furthermore, it has been determined that the strength of the conventional hold-down is lacking in response to certain lateral stresses applied thereto, because of its construction, so that when the power feed causes the template to strike the hold-down, the latter readily breaks. This causes costly downtime as well as reject product.

SUMMARY OF THE INVENTION

This invention provides a novel material hold-down unit for stitching machines, particularly useful in combination with automatic digitized stitching machines as used for example in the footwear manufacturing trade.

The unit enables the use of relatively narrow cutout openings in the template so that the layers of material being stitched can be securely clamped close to the needle, for maximum effectiveness and minimum risk of unclamped layer edges.

The hold-down unit has unique construction with corresponding strength to resist forces from all directions around its periphery. It uniquely interfits with the reciprocating needle bar for cooperative strength in combination therewith, as well as assured alignment between the needle and the hold-down even though the combined thickness of the layers varies.

Yet even with all these advantages, the novel hold-down is less expensive to manufacture than the prior art units.

These and other objects, advantages and features of the invention will be readily apparent to those in the art from the following specification taken in conjunction with the drawings.

DESCRIPTION OF THE PREFERRED EMBODIMENTS

Figure 1:
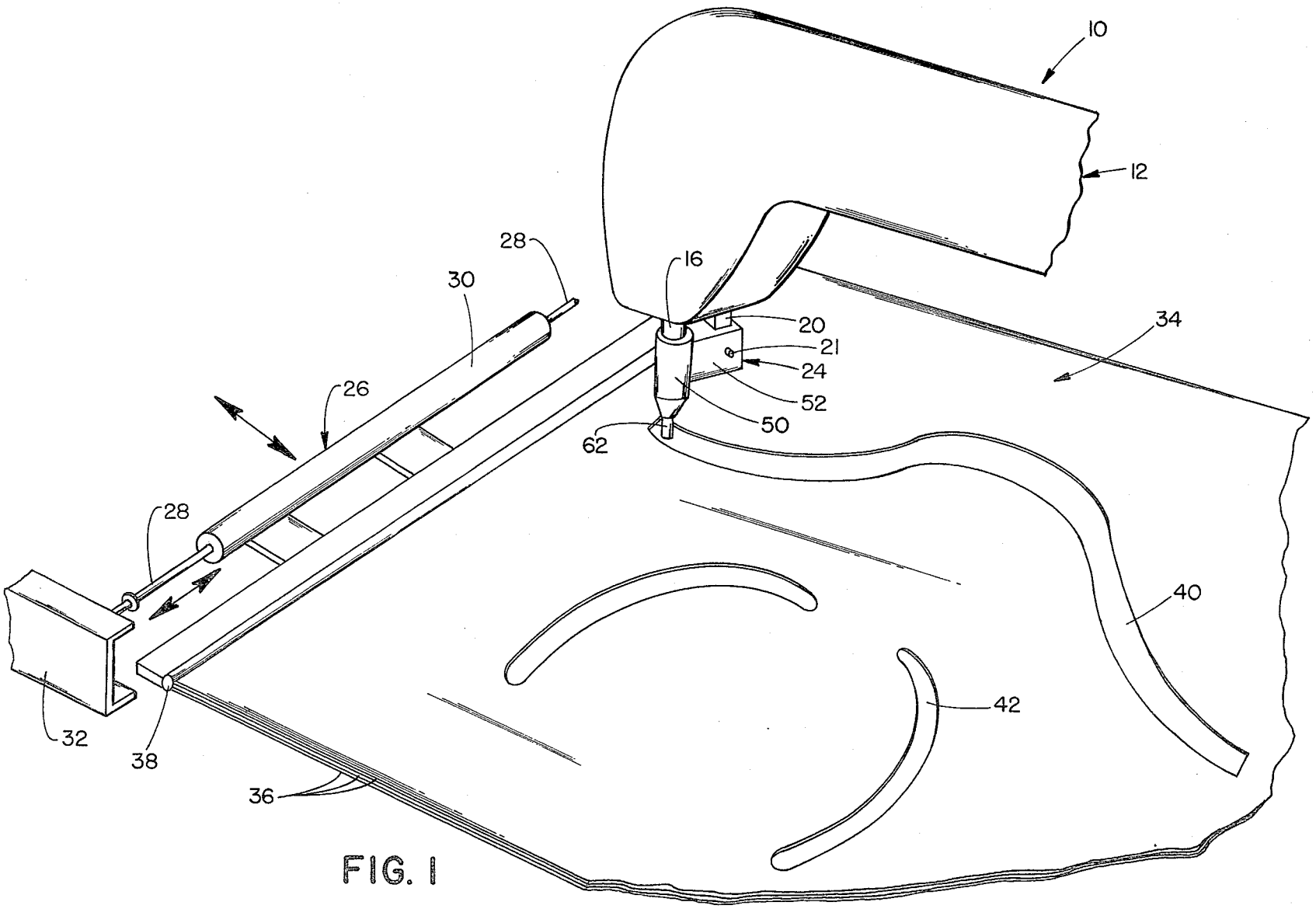
FIG. 1 is a perspective view of a stitching machine employing a hold-down unit in accordance with this invention.
Figure 7:
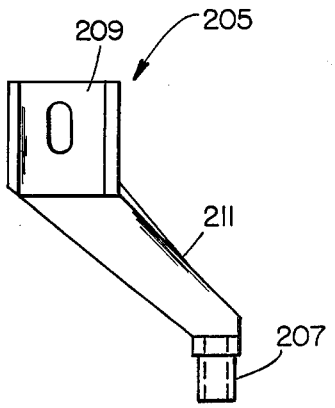
FIG. 7 PRIOR ART
FIG. 7 is a front elevational view of the prior art hold-down.
Figure 8:
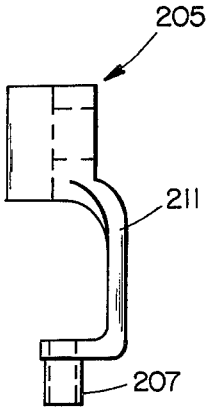
FIG. 8 PRIOR ART
FIG. 8 is an end elevational view of the prior art hold-down unit in FIG. 7.
Figure 3:
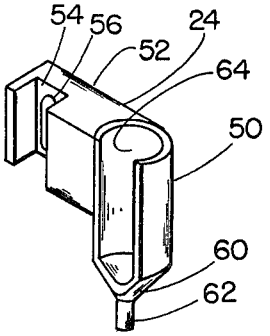
FIG. 3 is a perspective view of the hold-down device of this invention.
Figure 5:
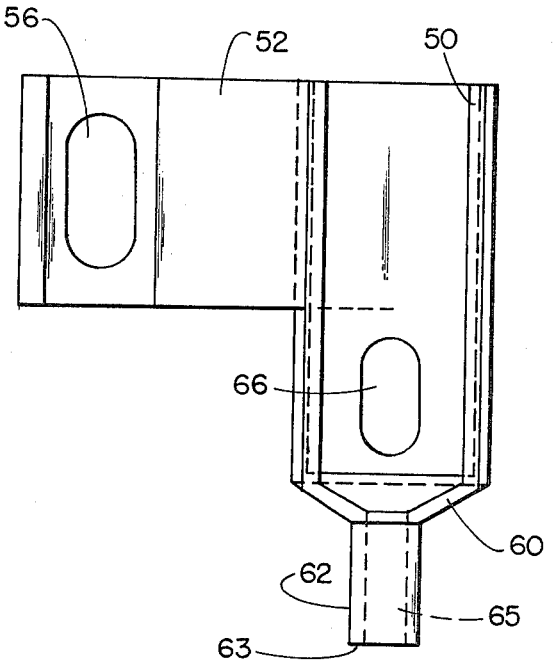
FIG. 5 is an elevational view of the device in FIGS. 3 and 4.
Figure 4:
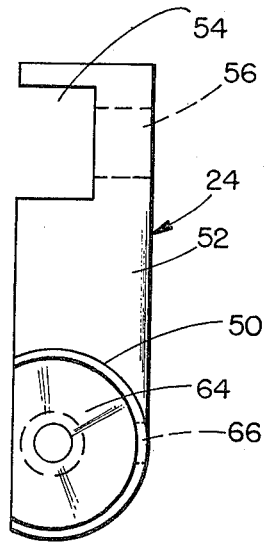
FIG. 4 is a plan view of the device in FIG. 3.

Referring now to the drawings, particularly to FIG. 1, the stitching apparatus 10 there shown comprises a conventional stitching or sewing machine subassembly 12, e.g. a Pfaff Model 335 or the like, employing a lower bed plate 14 upon which the work rests and retaining the conventional lower bobbin (not shown). The machine includes a conventional downwardly projecting needle bar 16, usually of cylindrical configuration, into the lower end of which is attached the stitching needle 18 retained in the needle bar by a turn screw 19. Alongside the needle bar 16 is a depending mount 20 of conventional type, to which is typically secured the material hold-down device of the prior art type shown at 205 in FIGS. 7 and 8. This prior art device had a slot 209 to receive mount 20, and a peculiarly shaped diagonal leg 211. The lower end of a small hollow cylindrical nose 207 engages the upper surface of the work to be stitched. In operation, the lower portion of leg 211 tended to be struck by the shifting template, and specifically the edge of the template opening.

With this present invention, the novel hold-down device 24 is mounted on this element 20 and cooperatively interfits with the vertically reciprocable needle bar 16 in a special manner to be described in detail hereinafter.

Positioned alongside the bed of the machine is preferably an automatic digitized feed control which employs a piston, double piston rod, and cylinder subassembly 26 for shifting the work in both directions of one dimension, the cylinder rods 28 extending from both ends of cylinder 30 and being mounted on transverse guide tracks 32 on opposite ends of the rod. These tracks allow movement in both directions of the dimension transverse to the first dimension noted. Thus, actuation of this conventional mechanism shown in a simplified form can shift the work varying amounts in two directions simultaneously to cause the stitching to follow a controlled pattern.

Figure 2:
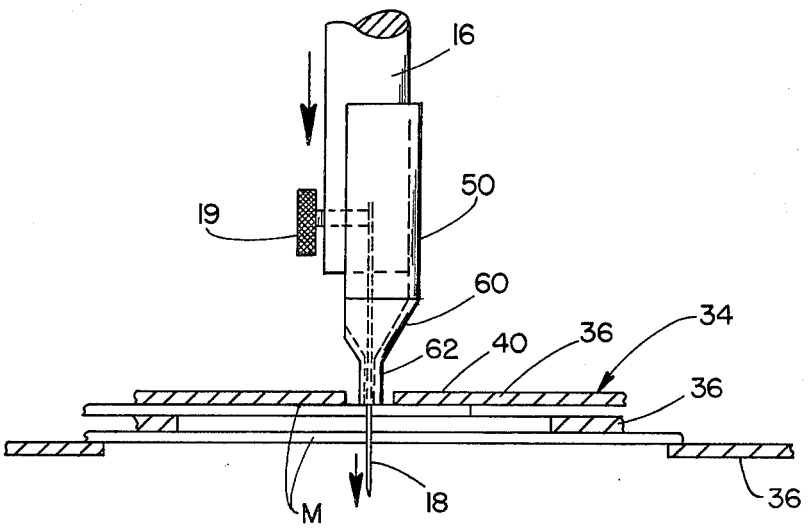
FIG. 2 is an elevational, fragmentary, sectional view of a portion of the apparatus in FIG. 1.

Referring to FIGS. 1 and 2, the layers of material M to be stitched together, (shown in simplified form as only two layers in FIG. 2, but typically comprising several) are retained in position between the sheets or leaves 36 of a book-type template 34 of conventional type. This template typically has the leaves 36 hingedly interconnected along one edge by a hinge mechanism 38 to enable easy insertion of the layers of material to be stitched. The hinged edge is interengaged with cylinder 30 to be shifted in the two directions during the stitching operation. The particular pattern of openings 40 and 42 in the template is predetermined to suit a particular shoe style or the like being assembled.

The material hold-down device 24 comprises a tubular cylindrical bearing sleeve 50, normally right cylindrical, to match the configuration of the needle bar with which is telescopically interfits and cooperates. Its internal diameter matches the external diameter of the needle bar so as to slidably receive such in the manner of a bearing. Projecting laterally from the upper portion of the sleeve is a mount portion 52. It includes a vertical slot 54 to receive the conventional mount 20 to which the unit is attached as by a threaded fastener through opening 56. The sleeve 50 is on a vertical axis, having a truncated portion 60, i.e. inverted frustoconical portion at the lower end thereof, which is hollow and has at its lower end a smaller diameter cylindrical hollow nose 62. At the lower end of nose 62 is an annular surface 63 for engaging the upper surface of the top layer of the layers being stitched. The nose has an internal opening 65 which is coaxial with sleeve 50 and larger then a stitching needle to allow the needle to reciprocate through it during the stitching operation. The needle bar reciprocates in the sleeve 50 during stitching. One side of the wall of sleeve 50 has a chordal slice portion removed therefrom to form a vertically elongated lateral opening 64. It extends peripherally an extent less than 180° of the sleeve circumference to leave greater than 180° extent of the sleeve wall remaining. This opening allows the turn screw to reciprocate with the needle bar and allows access to the needle bar, yet causing the sleeve to remain on the needle bar. A smaller opening 66 extends through the sleeve opposite the main opening 64 to allow threading of the needle.

During operation of the stitching machine on material for shoes or the like, the material hold-down device 24 is mounted to the stitching machine by sliding the sleeve 50 up over the needle and the stitching bar 16 to cause the needle 18 to project into the nose 62 of the unit. The mounting slot 56 is positioned over mount 20 and threaded fastener 21 (FIG. 1) inserted through the opening 56 of slot 54. The nose 62 has nothing projecting laterally from it like the prior art unit. In fact, neither does the frustoconical juncture or the lower portion of the sleeve. The vertical spacing between nose 62 and the upper mounting portion 52 of the unit enables the width of template openings 40 and 42 to be relatively narrow, which optimizes clamping action, yet without interference of the hold-down unit with the template edges.

The template book 34 is assembled with the multiple layers of material while removed from beneath the stitching head, the portions of the material being aligned with openings in the template sheets 36. The template book is then interengaged with the two dimensional control mechanism 26 and positioned such that the stitching mechanism is aligned with one of the openings, e.g. 40 as in FIG. 1, and stitching is initiated.

The frustoconical juncture between the nose and the sleeve provides excellent lateral support in all directions. It can readily accommodate lateral stress on the nose caused for example by increasing material thickness during the progressive stitching operation. The bearing interfit of sleeve 50 with the like configurated needle bar also lends excellent lateral support to the unit.

Figure 6:
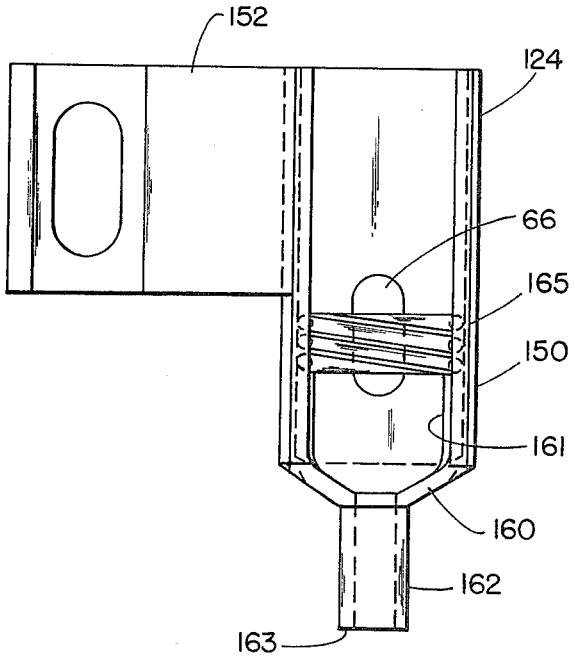
FIG. 6 is an elevational view of a modification of the hold-down unit.

In FIG. 6 is disclosed a second form of material hold-down unit 124 having a modified structure. The sleeve 150 here is not integral with the nose 162 and its material engaging lower end surface 163. Rather, there is a sliding interfit therebetween. Specifically, nose 162 is integral with frustoconical juncture 160 which in this embodiment includes an upwardly extending cylindrical portion 161 that telescopically slidably interfits within the open lower end of the sleeve 150. Biasing means such as a coil spring 165 is positioned between the upper axial end of portion 161 and the lower end of needle bar 16 to bias the nose 162 down into engagement with the material being stitched, while allowing resilient vertical movement of the nose to accommodate varying height of material thickness during stitching. The mounting portion 152 of this modified form is comparable to that at 52 in the previous embodiment.

The embodiments of the invention in which an exclusive property or privilege is claimed are defined as follows.

1. A material hold-down device for a stitching machine having a reciprocal needle retained in a reciprocal needle bar by a turn screw comprising:

a tubular cylindrical bearing sleeve to slidingly receive the needle bar, said sleeve having a chordal side opening for partial exposure of the needle bar and reciprocation of the turn screw relative to said sleeve, said opening being less than 180° extent leaving a portion of greater than 180° extent; a mounting portion extending laterally from said sleeve to mount said device to the stitching machine for reciprocation of the needle bar in said bearing sleeve; an elongated hollow nose coaxial with said sleeve to receive the reciprocal needle, joined to said sleeve by a frustoconical juncture, and having a material follower surface on the end thereof.

2. The device in claim 1 wherein said sleeve includes an outer sleeve portion and a lower inner sleeve portion telescopically fitted within said outer sleeve portion, said hollow nose being joined to said inner sleeve portion by said frustoconical juncture, and biasing means for biasing said inner sleeve portion, frustoconical juncture and hollow nose downwardly relative to said outer sleeve portion.

3. A material hold-down device in combination with a stitching machine having a reciprocal cylindrical needle bar and needle comprising:

a tubular cylindrical bearing sleeve to slidingly receive said needle bar, said sleeve having an open side of less than 180° extent; a mounting portion extending laterally from said sleeve to mount said device to the stitching machine; said sleeve slidably receiving said needle bar, and said needle bar being accessible through said lateral opening; an elongated hollow nose coaxial with said sleeve to receive the reciprocal needle, joined to said sleeve by a frustoconical juncture, and having a material follower surface on the end thereof.

* * * * *